US007566150B2

(12) United States Patent
Adrien

(10) Patent No.: US 7,566,150 B2
(45) Date of Patent: Jul. 28, 2009

(54) STREET LAMP

(75) Inventor: Yves Adrien, Montreal (CA)

(73) Assignee: Technilum, Beziers (FR)

( * ) Notice: Subject to any disclaimer, the term of this patent is extended or adjusted under 35 U.S.C. 154(b) by 8 days.

(21) Appl. No.: 11/659,700

(22) PCT Filed: Aug. 8, 2005

(86) PCT No.: PCT/EP2005/053891

§ 371 (c)(1),
(2), (4) Date: Jul. 31, 2007

(87) PCT Pub. No.: WO2006/015974

PCT Pub. Date: Feb. 16, 2006

(65) Prior Publication Data

US 2008/0031000 A1 Feb. 7, 2008

(30) Foreign Application Priority Data

Aug. 9, 2004 (FR) ..... 04 51812

(51) Int. Cl.
*F21S 8/08* (2006.01)

(52) U.S. Cl. ..... 362/418; 362/431; 248/125.2

(58) Field of Classification Search ..... 362/431, 362/410, 418; 211/107–111; 248/125.2, 248/124.1
See application file for complete search history.

(56) References Cited

U.S. PATENT DOCUMENTS

| | | | | |
|---|---|---|---|---|
| 1,271,557 A | | 7/1918 | Forsyth | |
| 2,156,768 A | * | 5/1939 | Niemann | 362/296 |
| 2,848,117 A | | 8/1958 | Miller | |
| 4,744,537 A | * | 5/1988 | Buckley | 248/219.1 |
| 4,856,747 A | * | 8/1989 | Gano | 248/354.7 |

FOREIGN PATENT DOCUMENTS

| | | |
|---|---|---|
| DE | 199 02 156 A1 | 8/2000 |
| EP | 1 310 932 A | 5/2003 |
| WO | WO 00/23972 A | 4/2000 |

* cited by examiner

*Primary Examiner*—Ali Alavi
(74) *Attorney, Agent, or Firm*—Sughrue Mion, PLLC

(57) ABSTRACT

A street lamp comprising a lamp post (1) and at least one accessory support member (10) supporting at least one accessory (20), said post (1) being cylindrical, at least one accessory support member (10) having manual adjustment means (30) enabling the position of said at least one accessory support member (10) on said post (1) to be adjusted manually, said adjustment means (20) enabling the height and/or the position of said at least one accessory support member (10) to be adjusted in elevation and/or in azimuth relative to said post (1).

8 Claims, 2 Drawing Sheets

STREET LAMP

The present invention relates to a piece of street furniture, such as a street lamp.

In the field of street furniture, and in particular in the field of public lighting, there is an ever increasing demand for street lighting that can be modulated depending on the surroundings and the events that are likely to occur. Similarly, on a given road, public lamp posts are often identical for reasons of appearance, and this applies even if the road widens from time to time or requires lighting that is more precise in certain zones. Here also, units that can be modulated, in particular that enable the position of the light fitting to be adjusted, are desirable.

An object of the present invention is thus to provide a piece of street furniture that can be modulated, in particular that can be adjusted in height and/or in inclination.

Another object of the invention is to provide such a piece of street furniture that is simple and inexpensive to fabricate and to assemble, that is simple to manipulate manually, and that presents reliability of materials and a good assembly technique.

The present invention thus provides a street lamp as defined by claim 1.

Advantageous characteristics are described in the dependent claims.

Figure 1:
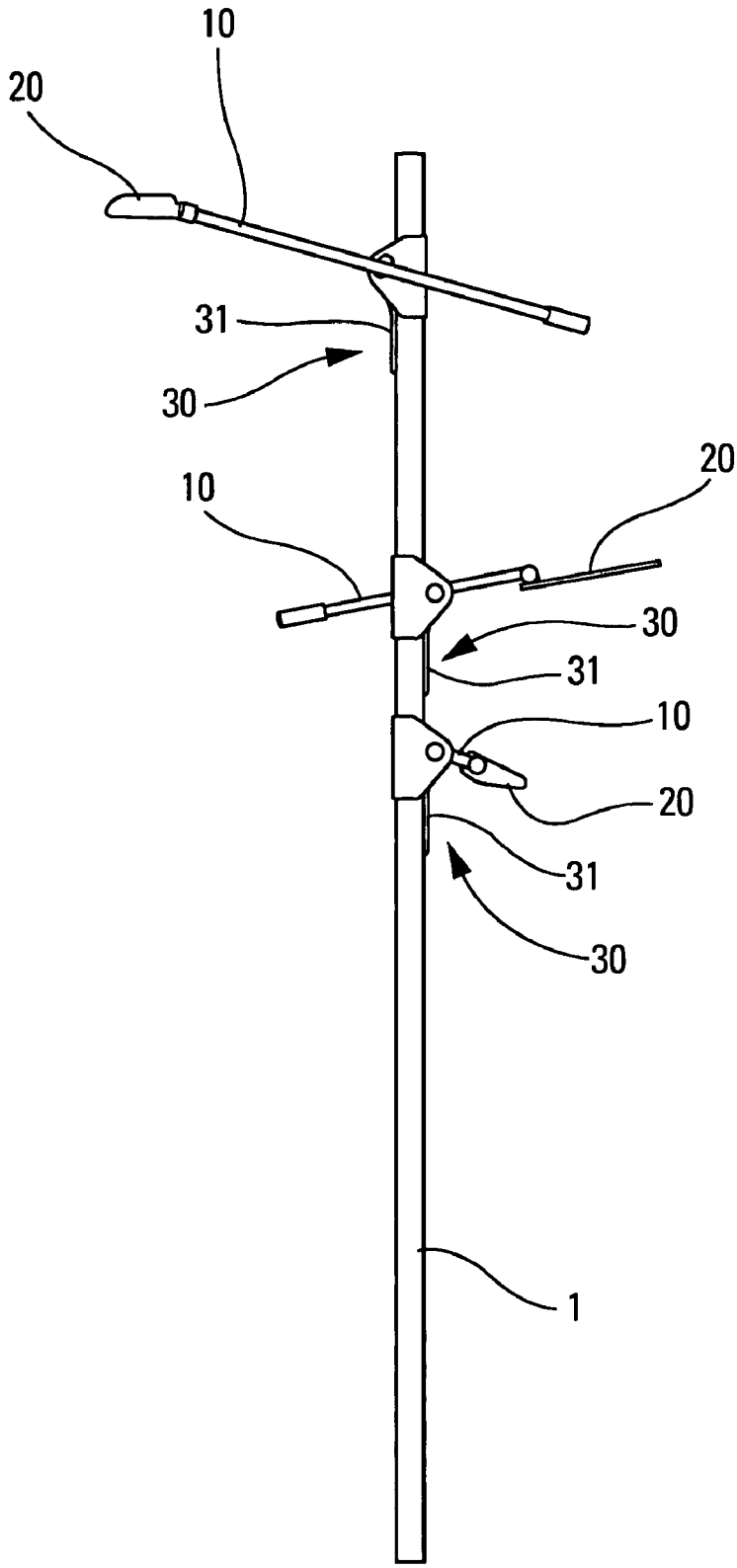
Figure 2:
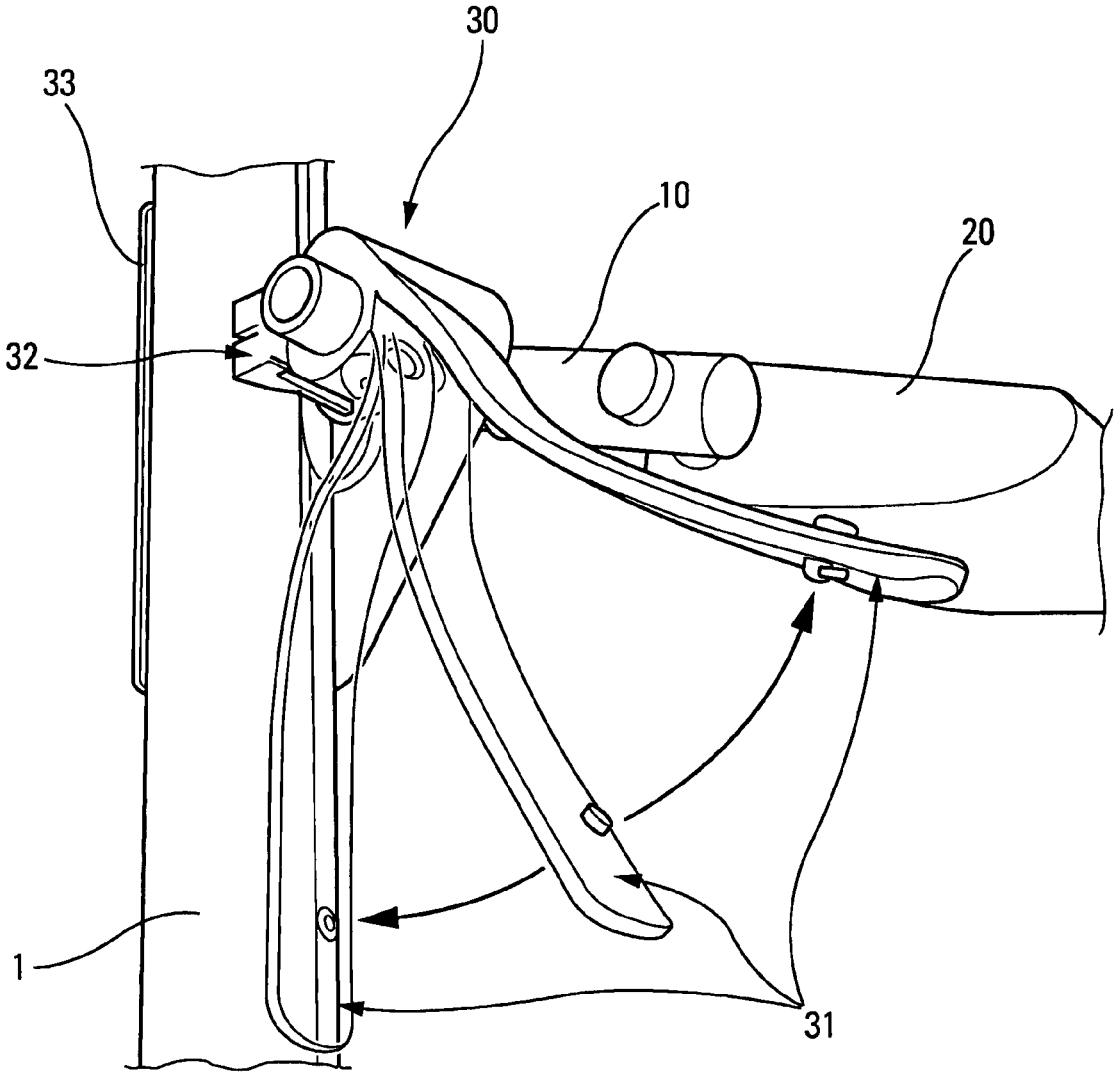

Other characteristics and advantages of the present invention appear more clearly from the following detailed description of an advantageous embodiments thereof made with reference to the accompanying drawings given as non-limiting examples, and in which:

FIG. 1 is a diagrammatic perspective view of a lamp post in an advantageous embodiment of the present invention; and FIG. 2 is a diagrammatic perspective view of adjustment means in an advantageous embodiment of the present invention, with three positions of the adjustment means being shown simultaneously in the figure.

FIG. 1 shows a lamp post to which the present invention can be applied. The lamp post 1 is cylindrical and supports a plurality of accessory support members 10, each comprising one or more accessories 20, which in the example shown are lighting elements.

According to the invention, the assembly includes manual adjustment means 30 that make it possible manually and simply to adjust the position and/or the inclination of each accessory support member 10 relative to said post or post 1, in particular in elevation and/or in azimuth.

FIG. 2 shows these adjustment means in greater detail. Advantageously, a lever 31 is provided that is mounted to pivot between a locking position and an adjustment position. FIG. 2 is a diagram showing three positions of the lever, namely its locking position, in which the lever is pressed completely against the post 1, an intermediate position, and the adjustment position in which the lever is pivoted away from the post 1. Advantageously, the lever 31 pivots about an axis that is eccentric relative to the post 1, i.e. that is not radial relative to said cylindrical post 1. Radial presser means 32, 33 advantageously co-operate with the post 1. These presser means may comprise a cylindrical sleeve 33 placed around the post 1, with displacement of the lever 31 towards its locking position causing said sleeve 33 to be tightened around the post 1.

Advantageously, said lever co-operates with presser block type means 32. When the lever is lowered into the locking position, a compression force is exerted by the presser block 32 to press the post 1 against an outer sleeve 33 secured to the accessory support member 10. An appropriate length for the lever 31 enables this assembly to be manipulated by hand in very easy manner, while nevertheless guaranteeing fastening that is certain and reliable in the locking position. This ease of installation is particularly apparent when the presser block acts as an eccentric. Advantageously, the present invention makes it possible to adjust not only the height of the accessory support member relative to the post 1, but also its inclination.

The present invention thus provides a system for fastening an accessory, such as a light fitting, that makes it easy to adjust the height and the angle of exposure of said accessory relative to a cylindrical post. The invention makes it possible in particular to support a plurality of types of lighting (direct or indirect), makes it possible manually to adjust the lighting element relative to the post, and it also makes it possible to adjust the angle of the arm or the support member 10 for said light fittings, enabling a plurality of supports to be integrated on a single post. The present invention also makes it possible to use cylindrical posts made of aluminum that is particularly strong, the accessory support member 10 together with the sleeve 33 providing fastening by clamping possibly also being made of aluminum. The use of aluminum, in particular in alloy form, guarantees strength and good quality, also making it possible to avoid welding that might present points of weakness or that might be poor in appearance.

Naturally, for a lamp post, the lighting elements 20 are generally connected to the inside of the post 1 by cables, and a pulley system can be provided inside the post to guide and also to protect the cable for powering the lighting elements independently of the height selected for the accessory support member 10.

Although the present invention is shown with reference to one particular embodiment thereof, it should be understood that it is not limited to this embodiment shown in the figures, but on the contrary is applicable to other variants that can be envisaged by the person skilled in the art. Thus, the accessories could be elements of signals. Other variants can also be envisaged. The outside shape of the post 1 could also be different, and in particular it could include grooves or a decorative profile, providing a generally cylindrical shape is maintained. For example, a profile that can be inscribed within a geometric cylinder could be envisaged. Similarly, the specific shape of the lever could be different. Other modifications can also be envisaged without going beyond the ambit of the present invention as defined by the accompanying claims.

The invention claimed is:

1. A street lamp comprising a lamp post (1) and at least one accessory support member (10) supporting at least one accessory (20), wherein said post (1) is cylindrical, at least one accessory support member (10) having manual adjustment means (30) enabling the position of said at least one accessory support member (10) on said post (1) to be adjusted manually, said adjustment means (20) enabling the height and the position of said at least one accessory support member (10) to be adjusted in elevation and in azimuth relative to said post (1);

wherein said adjustment means include a presser block actuated by a lever manually displaceable between a locking position and an adjustment position.

2. A lamp according to claim 1, in which said adjustment means (30) comprise a manually-actuated lever (31), said lever (31) being pivotable between a locking position holding the position of the associated support member (10) stationary relative to said post (1), and an adjustment position enabling said support member (10) to be moved relative to said post (1).

3. A lamp according to claim 1, in which said lever (31) is associated with radial presser means (32, 33) co-operating with said post (1), said presser means (32, 33) being clamped in stationary manner against said post (1) when the lever (31) is in the locking position.

4. A lamp according to claim 3, in which said radial presser means (32, 33) include a cylindrical sleeve (33) placed around said post (1).

5. A lamp according to claim 1, in which the presser block (32), when the lever (31) is in the locking position, presses the post (1) against an outer cylindrical sleeve (33) placed around said post (1).

6. A lamp according to claim 1, in which said presser block (32) acts as an eccentric for clamping the adjustment means (30) when the lever (31) is moved into the locking position.

7. A lamp according to claim 1, in which said at least one accessory (20) is a lighting element.

8. A lamp according to claim 1, in which said at least one accessory (20) is a signal element.

* * * * *